US005947023A

United States Patent [19]

Bohrer et al.

[11] Patent Number: 5,947,023

[45] Date of Patent: Sep. 7, 1999

[54] SHAFTLESS ROTARY PRINTING PRESS

[75] Inventors: Wolfgang Bohrer, Frensdorf; Walter Möller-Nehring; Horst Zimmermann, both of Erlangen; Heiko Schröder, Ahrensburg, all of Germany

[73] Assignee: Siemens Aktiengesellschaft, Munich, Germany

[21] Appl. No.: 09/043,693

[22] PCT Filed: Sep. 16, 1996

[86] PCT No.: PCT/EP96/04059

§ 371 Date: Jun. 4, 1998

§ 102(e) Date: Jun. 4, 1998

[87] PCT Pub. No.: WO97/11848

PCT Pub. Date: Apr. 3, 1997

[30] Foreign Application Priority Data

Sep. 28, 1995 [EP] European Pat. Off. ..... 95115330

[51] Int. Cl.[6] ..... B41F 5/06; B41F 5/08; B41F 13/004

[52] U.S. Cl. ..... 101/181

[58] Field of Search ..... 101/181, 182, 101/183, 220, 219, 228, 178, 179, 180, 184, 185, 136–140, 142–145; 318/43, 85, 47, 49; 364/469.03

[56] References Cited

U.S. PATENT DOCUMENTS 3,557,692 1/1971 Lee ..... 101/177

FOREIGN PATENT DOCUMENTS 0 567 741 3/1993 European Pat. Off. .
567 741 11/1993 European Pat. Off. .
39 06 646 9/1989 Germany .
2 261 629 5/1993 United Kingdom .
2 281 534 3/1995 United Kingdom .

OTHER PUBLICATIONS

B. Fuchs, "Dem längswellenlosen Maschinenantrieb gingen viele Versuche voraus", Print 39, 1994.

*Primary Examiner*—J. Reed Fisher
*Attorney, Agent, or Firm*—Kenyon & Kenyon

[57] ABSTRACT

A shaftless rotary printing press includes a plurality of individually driven printing stations and at least one separately driven folding unit. The drives which work with one folding unit in one rotation are connected to a drive control unit by a control and parameterization bus and to a device for generating a setpoint and a synchronization signal by means of a parallel synchronization bus, and the drives are each connected to the synchronization bus, which is designed as a ring bus by a bus interface. This yields a rotary printing press without shafting which is so flexible that its printing stations can be synchronized with any desired folding unit from one production to another simply and inexpensively.

14 Claims, 5 Drawing Sheets

| OUTPUT \ INPUT | 1E | 2E | 3E | 4E |
|---|---|---|---|---|
| 1A | X | | | |
| 2A | | | X | |
| 3A | | X | | |
| 4A | | | | X |

X: INPUT AND OUTPUT CONNECTED

| OUTPUT \ INPUT | 1E | 2E | 3E | 4E |
|---|---|---|---|---|
| 1A | | | | |
| 2A | | X | | |
| 3A | X | | | |
| 4A | | X | | |

X: INPUT AND OUTPUT CONNECTED

SHAFTLESS ROTARY PRINTING PRESS

FIELD OF THE INVENTION

The present invention relates to a rotary printing press.

BACKGROUND INFORMATION

A newspaper offset rotary printing press, referred to hereinafter as a rotary printing press, usually includes a plurality of producing units, called rotations, which can operate simultaneously and independently of one another (maximum 10). Each producing unit includes of reel stands for the paper rolls, draw rollers for feed and delivery of the paper web at the printing towers, printing stations which are combined as U printing groups (two printing stations), Y printing groups (three printing stations) or H printing groups (four printing stations) in one or more printing towers, auxiliary drives on the printing stations (e.g., for changing plates) and the folding unit.

A rotation is usually controlled by a plurality of programmable controller systems, which are in turn guided by higher-level control centers. To permit efficient data exchange, the systems are networked over serial bus systems.

A printing station includes a rubber cylinder, a plate cylinder and an inking and dampening unit. One ink color can be printed on one side with each printing station. A rotation includes all the printing stations which operate on one folding unit, i.e., all their printed paper webs are sent to one folding unit. The printing stations in a machine are accommodated in printing towers, a maximum of eight printing stations in one tower (eight-station tower). In the future, ten printing stations in one tower (ten-station tower) will be the goal. In one rotation, a maximum of twelve eight-station towers can work with one folding unit.

FIG. 1 shows a conventional rotary printing press with shafts. One, or in many cases even two mechanical longitudinal shafts 2 linked by gears 4 (e.g., conical gears) and mechanical vertical shafts 6 in printing towers 8, 10, 12 permit, due to rigid coupling, angular synchronization of all printing stations 14 with one another and with a folding unit 16 or 18 within one rotation. Synchronization is always necessary only within one rotation. Longitudinal shaft 2 runs through the entire machine and is usually driven by a plurality of main motors—for reasons pertaining to flexibility and torque distribution. Coupling and uncoupling of vertical shafts 6 and printing groups 20 take place by means of mechanical couplings 22. Furthermore, additional separating couplings 24 must be incorporated into longitudinal shaft 2 if individual printing towers 8 and/or 10 and/or 12 are to work in different rotations. By opening longitudinal shaft coupling 26 between printing tower 8 and printing tower 10, two rotations can operate independently of one another—printing tower 8 with folding unit 16 and printing towers 10 and 12 with folding unit 18.

The flexible allocation of printing stations 14 to a plurality of folding units 16 and 18 is determined exclusively by the mechanics. Any increase in flexibility must come at the price of an increased expense in terms of mechanical components (higher cost of acquisition of the machine).

Disadvantages of the conventional drive design with mechanical shafts include:

- complicated and expensive mechanisms (gears, couplings),
- low flexibility in production,
- limited accuracy of printed images due to gear play, torsion of the shafts, manufacturing tolerances of the mechanical components, e.g., ±50 μm in the print in newspaper rotations,
- tendency to vibration due to low mechanical natural frequencies, and
- high maintenance for the mechanical parts and for start-up of operation.

For more than 30 years, there have been repeated attempts in the area of printing press development to replace the synchronization of the drive components by means of mechanical shafts with a synchro. This is done in conjunction with replacement of the d.c. technology with three-phase technology. In the 1960s and 1970s, several attempts were made in the development departments of printing press manufacturers Wifag, MAN Roland, in collaboration with electronics companies to introduce a drive technology without longitudinal shafts for gravure printing presses. However, this has not gone beyond the experimental stage in gravure printing technology. This research was not resumed until the beginning of the 1990s, this time in the area of rotary offset machines for newsprint. Hamada Printing Press Co. Ltd., the Japanese rotary (printing) machine manufacturer, developed a machine using only three-phase motors for each printing cylinder and each draw roller. The machine had no longitudinal shaft and no register rolls.

For the last several years, there has been increasing activity with regard to newspaper rotary presses in an attempt to replace the mechanical shafts, gear and couplings with a drive design having a single drive with synchronization via a synchro. ABB, in cooperation with Wifag, presented a rotary printing press without shafting at IFRA 94 in Munich. In this eight-station tower printing press, each printing station, each draw roller, and the folding unit were provided with a three-phase motor. All the longitudinal shafts and vertical shafts with conical gears and couplings were therefore eliminated, thus preventing most torsional vibration. The individual drive elements of a rotation are linked together only by a fast data line—a synchro. Synchro control is decentralized in the converter. Setpoints for the converter are selected and synchronized over a very fast serial field bus system. The SERCOS bus system is mainly used. This background information is described in an article entitled "Dem langswellenlosen Maschinenantrieb gingen viele Versuche voraus" Many Experiments Preceded the Longitudinal Shaftless Machine Drive), printed in the journal *PRINT*, Volume 39, 1994.

Newspaper rotary presses are trendsetters in the printing industry and are thus pioneers in the introduction of new drive designs. Technologies that prove successful in this field will also be introduced in other printing fields, such as gravure printing or printing of illustrations, packages, etc.

Trends in the printing industry include:

- greater flexibility (mixed production, target-group-oriented products),
- greater productivity (shorter set-up times, higher production speed, less waste),
- higher print quality (long-term constancy and greater accuracy <±20 μm in the print),
- better economy (lower operating costs), and
- lower cost of acquisition of the machine.

European Patent Application No. 0 567 741 describes a rotary printing press where the cylinders and at least one folding unit are driven directly. Several drives of the cylinders and their drive controllers are combined into printing station groups which can be allocated to one web of paper.

The printing station groups are connected to the folding unit and to an operating and data processing unit over a data bus. Within the printing station groups, the individual drives of the cylinders and their drive controllers are connected over a high-speed bus system. The printing station groups obtain their position difference directly from the folding unit. The higher-level control system is responsible only for selecting setpoints and deviations and for processing actual values. The higher-level control system is connected to a printing station group via the data bus, a drive system and a high-speed bus system. The positioning of individual drives relative to one another and to the folding unit is regulated in the drive system. In the drive system, data and commands coming from the higher-order control system are also adapted to the form needed for the drive controllers. Overall control over the data bus is limited to selection of setpoints, setpoint deviations, actual values, and setpoint control. Parameters for precision adjustment of the individual drives are calculated separately for each printing station group in the drive system.

With this rotary printing press, the printing station groups can be controlled only as a whole by one folding unit or another due to the fact that the entire control system is divided into a higher-order control system and autonomous printing station groups. However, it is impossible to integrate individual printing stations which are synchronized in one production with one folding unit into another production taking place in another rotation, synchronized with a second folding unit. Thus, the flexibility of this drive design is limited.

SUMMARY OF THE INVENTION

The object of the present invention is to create a drive design for a shartless rotary printing press which is so flexible that its printing stations can be synchronized with any desired folding unit from one production to another.

The drive of each printing station receives all the information needed to operate the printing station because each drive working in one rotation with one folding unit receives signals for control, diagnosis and parameterization over a control and parameterization bus and receives only information to ensure angular synchronization of the drives in one rotation over the synchronization bus. Each drive can thus be regarded as the smallest complete unit of a rotary printing press without shafting which can be integrated into any desired rotation depending on the print product. Because of the use of two separate buses controlled in parallel, the basic design of a rotary press shown in FIG. 1 is maintained, with one of the two buses, namely the high-speed bus, replacing the mechanical shafts through implementation of a synchro. Information management for controlling the drives of such a rotary printing press shown in FIG. 1 remains the same.

The flexible assignment of printing stations to a plurality of folding units in one rotary printing press shown in FIG. 1 is determined exclusively by the mechanics, with any gain in flexibility coming at the expense of increased cost and complexity of the mechanical components. In the embodiment of a rotary printing press without shafting according to this invention, the flexible assignment of the printing order of the printing stations to a plurality of folding units is not disturbed, because each drive continues to receive its operating information over the control and parameterization bus and can be incorporated into a drive design easily by means of the synchronization bus.

The basis of the drive design according to the present is a strict separation between the control/parameterization function and the function of the synchro on the drive. The result when put into practice is that a control unit can access the drive over a control and parameterization bus for control and parameterization functions. In parallel therewith, there is a device for generating a setpoint and a synchronization signal, for implementation of the synchro. The device selects the clock pulse and the setpoints for angular synchronization of the drives over a synchronization bus. The synchro thus replaces, one for one, the function of synchronization of printing stations over the mechanics.

The following advantages are obtained by this embodiment according to the present invention:

Straightforward design and simpler handling of the drive in synchronous operation (=the printing station is coupled and running in synchronization) and in isolated operation (=the printing station is uncoupled, e.g., for set-up work from an ongoing rotation). The drive can also be controlled, parameterized and diagnosed at any time without operating the synchronization bus.

Only information ensuring angular synchronization of the drives in one rotation is transmitted over the synchronization bus. No control or parameterization data is transmitted. Thus, more than 100 drives in one rotation can be supplied with individual information at least once every two milliseconds.

In an advantageous rotary printing press without shafting having a plurality of driven printing stations, some of which are synchronized with a first folding unit and the others are synchronized with a second folding unit, at least a few of the printing shafts working in first rotation are connected to the synchronization bus of the second rotation by a second bus interface, with one bus switch being arranged in synchronization buses designed as ring buses. Therefore, in the event of failure of a folding unit of one rotation, it is possible for the printing stations of this rotation to work easily and without any delay with an adjacent folding unit. Due to the use of bus switches, it is possible to connect all the printing stations of one rotation which are connected to one another by a synchronization bus into a synchronization bus ring of another rotation. This design provides a simple solution for the redundancy requirements of rotary printing presses, and in the event of a disturbance, production can be maintained at least in emergency operation without any great time lag.

DETAILED DESCRIPTION OF THE INVENTION

Figure 2:
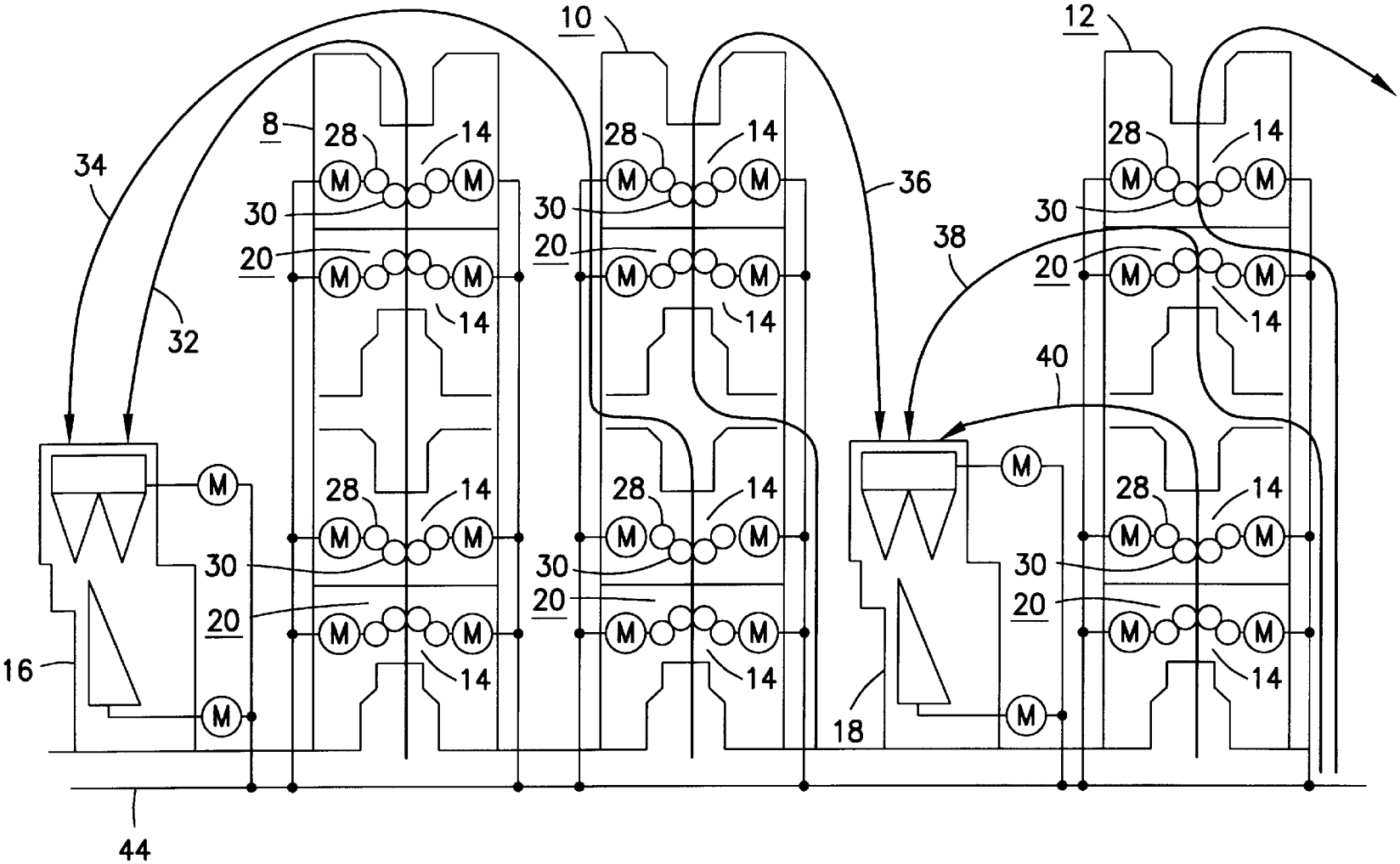
FIG. 2 shows a shaftless rotary printing press including a synchro in accordance with an exemplary embodiment of the present invention.

FIG. 2 shows a shaftless rotary printing press comprising two folding units 16 and 18 and three printing towers 8, 10 and 12. Each of these three printing towers 8, 10 and 12 has two H printing groups 20, each comprising four printing stations 14. Each printing station 14 includes a rubber cylinder 28, a plate cylinder 30 and an inking and damping unit. One ink color can be printed on one side with each printing station 14. All printing stations 14 which work with one folding unit 16 or 18, i.e., their printed paper webs 32 and 34 or 36, 38, 40, are guided to folding unit 16 or 18, belong to one rotation. A maximum of up to twelve printing towers 8, 10 and 12, each with a maximum of eight printing stations 14, can work with one folding unit 16 or 18.

Each printing station 14 in the rotary printing press is driven directly by one drive unit including a three-phase motor with a suitable converter. The same applies to the drive of folding units 16 and 18. The mechanical coupling between the three-phase motor and rubber cylinder 28 may be a direct coupling or it may be a gear or a toothed belt. The type of mechanical coupling depends on the drive dynamics required. Angular synchronization of printing stations 14 relative to one another and to folding units 16 and 18 is controlled in each converter with underlying rpm and torque control. Encoders with 2048 sine/cosine signals, for example, are used to meet an accuracy of ±20 $\mu$m with a cylinder circumference of 1 m between individual printing stations 14 (circumferential registers) and ±50 $\mu$m between printing stations 14 and folding unit 16 and 18 (cutting registers). The actual position of rubber rolls 28 is detected by an encoder mounted directly on the cylinder. Thus, errors which can occur with mechanical coupling of the motor shaft and rubber cylinder 28, have no effect on the actual value signal for regulation of angular synchronization.

The sine/cosine signals entered are set in a data acquisition unit at approximately four million increments per revolution in the converter, and sent to the angular synchronization control as a high-resolution actual value. A second encoder integrated into the motor is used for rpm control and torque control.

Figure 1:
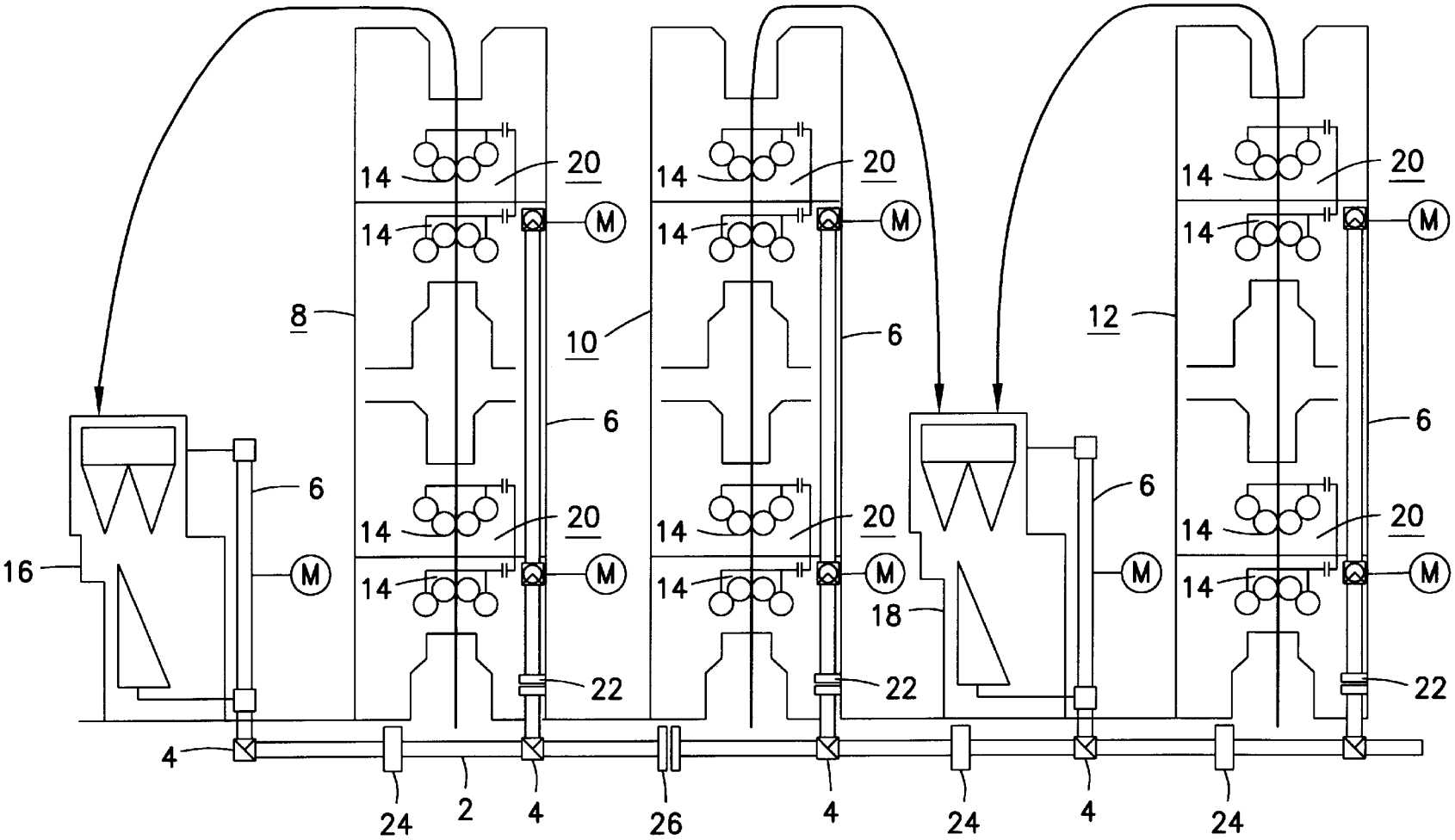
FIG. 1 shows a conventional rotary printing press with shafts.

Instead of mechanical longitudinal shaft 2, gear 4 and vertical shafts 6 of the rotary printing press shown in FIG. 1, a control and parameterization bus 42 and a synchronization bus 44 are provided with the shaftless rotary printing press shown in FIG. 2. Only synchronization bus 44 is shown in this diagram. Each drive of a printing station 14 is linked to synchronization bus 44. For the sake of simplicity, only electric motor M of the drive of this printing station 14 is shown.

In a comparison to the conventional drive system of a rotary printing press (FIG. 1), with a drive design of a rotary printing press according to the present invention (FIG. 2), it can be seen that mechanical shafts 2 and 6 have been replaced by synchronization bus 44, but there have not been any changes in the drive design. With the elimination of shafts 2 and 6, individual drives which are supplied with information over control and parameterization bus 42 are provided for each printing station 14. This yields the possibility of controlling and parameterizing each individual drive even if there is no synchro between these individual drives.

Due to the strict separation of the control/parameterization functions and the function of the synchro, each drive which works with one folding unit 16 or 18 can be combined to any desired rotation with any other drive of the drive design of the rotary printing press by means of synchronization bus 44, with each of these drives being parameterized, controlled and monitored by means of control and parameterization bus 42.

Figure 3:
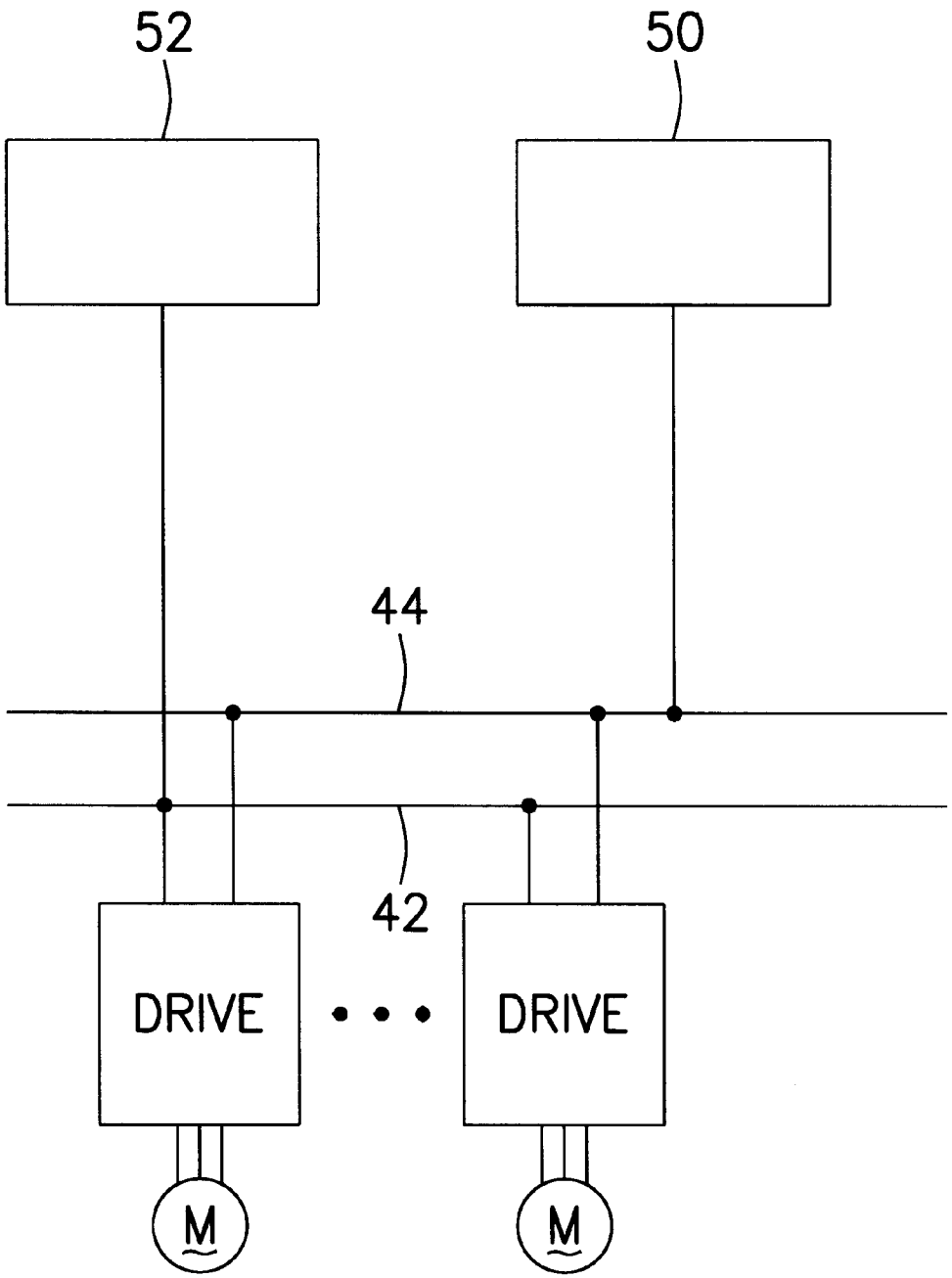
FIG. 3 shows a simplified drive design according to the present invention.

FIG. 3 shows the drive design according to the present invention in a simplified form. For this purpose, two drives are shown in greater detail. The two drives connected to control and parameterization bus 42 and to synchronization bus 44. The drive includes comprises two bus interfaces 46 and 48 (FIG. 4) for synchronization bus 44, a bus interface for the parameterization/control bus, a converter with integrated technology function, e.g., for angular synchronization, and electric motor M, which may be an asynchronous motor or a servo motor. Synchronization bus 44 is designed as a ring bus and is connected to a device 50 for generating a setpoint and a synchronization signal. Control and parameterization bus 42 is connected to a control unit 52. Control unit 52 controls, parameterizes and diagnoses the drive in synchronous operation exactly as in isolated operation. Device 50, which is at a higher level than the drive units, and control unit 52 are incorporated into the entire information exchange of the machine over another serial bus system, which may be designed as a redundant system (e.g., system control).

The individual drive units on printing stations 14 are synchronized with one another and with the drive unit in folding units 16 and 18 over serial synchronization bus 44. Synchronization bus 44 functionally replaces the mechanical longitudinal and vertical shafts 2 and 6 of the machine. The individual position setpoint is defined for each drive by device 50 over synchronization bus 44. The setpoint consists of the angle value of a control vector plus an individual offset angle for each drive. In addition, processing of the angular synchronization control, rpm control and torque control of each drive is synchronized at a common starting point over synchronization bus 44 by a synchronization signal, i.e., by a predetermined message to all users (e.g., broadcast). All the drives of one rotation are synchronized with one another due to the strict cyclical repetition of this synchronization signal over time.

The synchronization bus operates using a master-slave principle. A higher-level device 50 over the drive units is the master station of synchronization bus 44 (e.g., single master). The drive units are the slave stations. Synchronization bus 44 is designed as a ring bus using optical fibers. A maximum of 200 users can be connected to such a synchronization bus ring 54 or 56. The performance is designed so that 100 users can be supplied with individual setpoints every two milliseconds. Each rotation in the machine, i.e., ultimately each folding unit 16, 18 is assigned a device 50. Folding unit 16, 18 is thus the station with which printing stations 14 are synchronized, as is also the case with the connectional design with mechanical shafts. Drive units which are assigned to different devices 50 are not synchronized with one another.

The basis of a synchro is the generation of a central rotating control vector. In addition, an individual offset angle for each drive can also be added to the control vector in device 50. The instantaneous position of this angle value (i.e., control vector plus offset angle) is transmitted as a setpoint over synchronization bus 44 to the corresponding drive at a certain time in the time pulse of the synchronization signal of synchronization bus 44. Within the bus cycle time (i.e., time between two synchronization signals), all drives in one rotation are supplied with their individual angle values. Each drive follows its individual angle setpoint in position and speed (i.e., angular synchronization control). The speed at which the control vector rotates is determined from the predetermined web speed of the machine and the circumference of the printing rolls.

The offset angle for each drive is determined essentially from the register control. The position of each rubber roll can be varied individually with respect to the other rubber rolls and folding unit 16, 18 on the basis of the offset angle. The traditional register rolls and register carriages can be eliminated by this function.

The strictly time-equidistant synchronization signal is transmitted as the predetermined message to all users (i.e., broadcast). The interval between two synchronization signals can be parameterized. The sampling cycles of the converters for control of the angular synchronization, rpm and torque are synchronized with this synchronization signal.

Each drive is controlled separately from synchronization bus 44 over a second serial bus system 42. One or more drives can be controlled, parameterized and diagnosed by control unit 52 over control and parameterization bus 42. Open and standardized field buses such as PROFIBUS-DP or company-specific bus systems such as USS Protocol or ARCNET may be used as the bus systems for control and parameterization bus 42.

Figure 4:
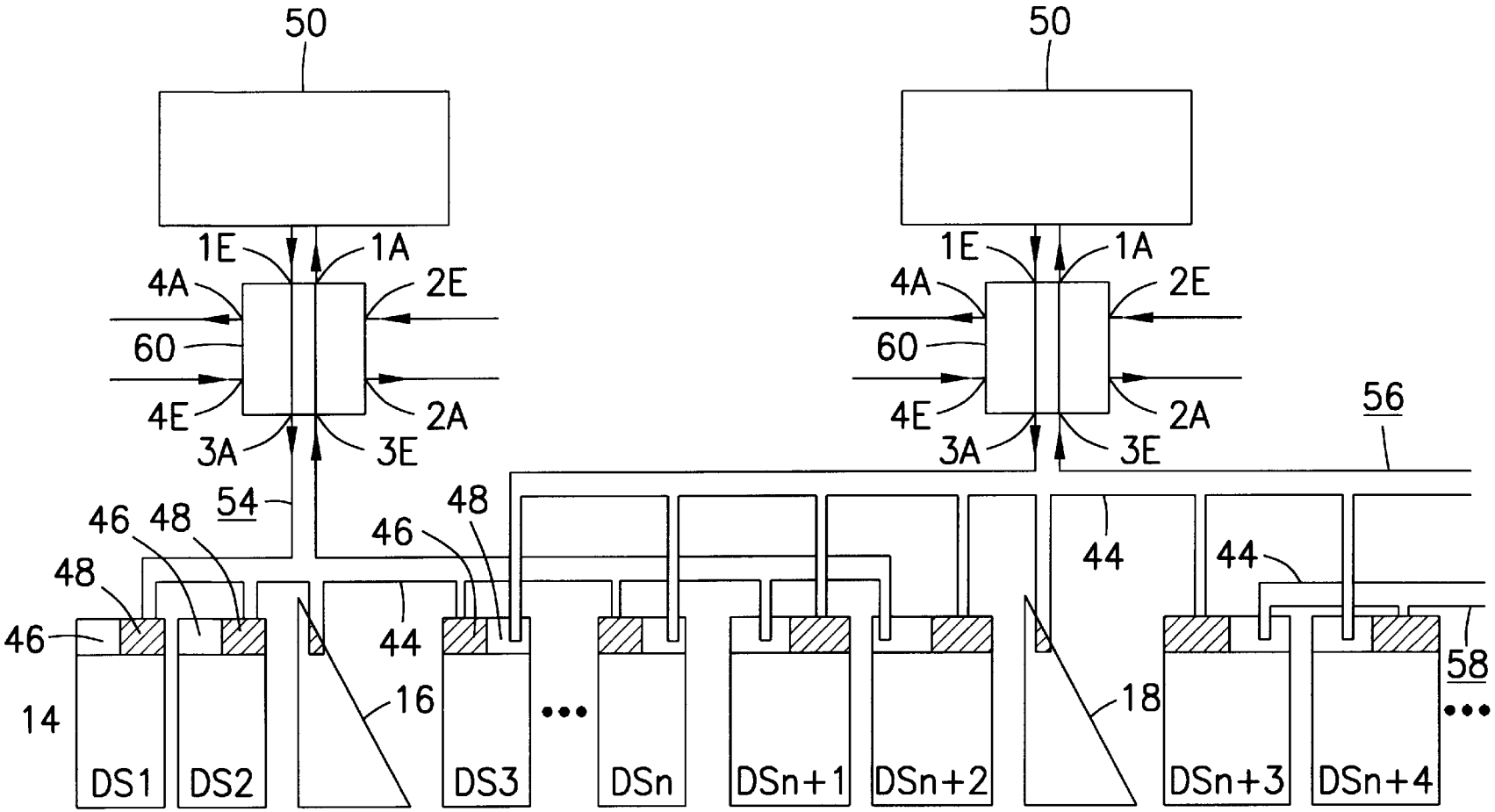
FIG. 4 shows an embodiment of the drive design according to the present invention with a built-in redundancy.

FIG. 4 shows a redundant design of the drive design of a rotary printing press without shafting according to the present invention. In this diagram, the plurality of printing stations 14 are numbered consecutively to facilitate an understanding of this redundant design. Each printing station DS1, . . . , DSn, DSn+1, DSn+4 has two interfaces 46 and 48 for connection to individual synchronization bus rings 54, 56 and 58. Printing stations DS1, . . . , DSn+2 are linked in synchronization ring 54, but of these printing stations DS1, . . . , DSn+2, printing stations DSn+1 and DSn+2 have not been activated for this synchronization bus ring 54. Activated bus interfaces 46 and 48 are shown in black, i.e., the respective drive accepts the setpoint selection and synchronization signal of device 50. Printing stations DS3, . . . , DSn+4 are linked in synchronization bus ring 56, but of these printing stations DS3, . . . , DSn+4, printing station DS3, DSn and DSn+4 are not activated for this synchronization bus ring 56. As shown FIG. 4, synchronization bus ring 56 is not shown completely. Likewise, synchronization bus ring 58 is also not shown completely. Printing stations DS1, . . . , DSn work with folding unit 16, whereas printing stations DSn+1, . . . , DSn+3 work with folding unit 18.

Each folding unit 16 and 18 is assigned a device 50 for generating a setpoint and a synchronization signal. Synchronization bus rings 54 and 56 are connected to respective device 50 by a bus switch 60. The diagram of bus switch 60 shows that its input 1E is wired directly to output 3A, and input 3E is wired directly to output 1A. The other inputs 2E, 4E and outputs 2A, 4A are not wired together. With this number of inputs and outputs, 24 combinations can be produced. Bus switch 60 is needed exclusively for implementation of the redundancy requirements with newspaper rotary presses. Bus switch 60 has essentially the function of permitting line control of synchronization bus 44, so that a device 50 of one rotation can easily be coupled into a synchronization bus ring of another rotation. One bus switch 60 is always assigned directly to a device 50.

Figure 5:
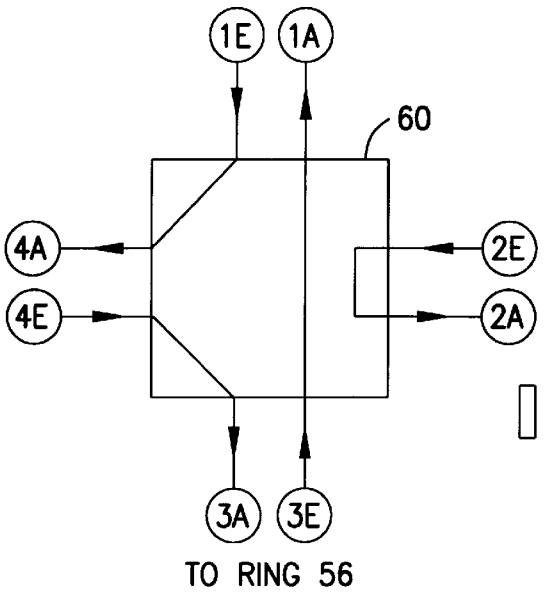
FIG. 5 shows two examples of a bus switch wiring.
Figure 5:
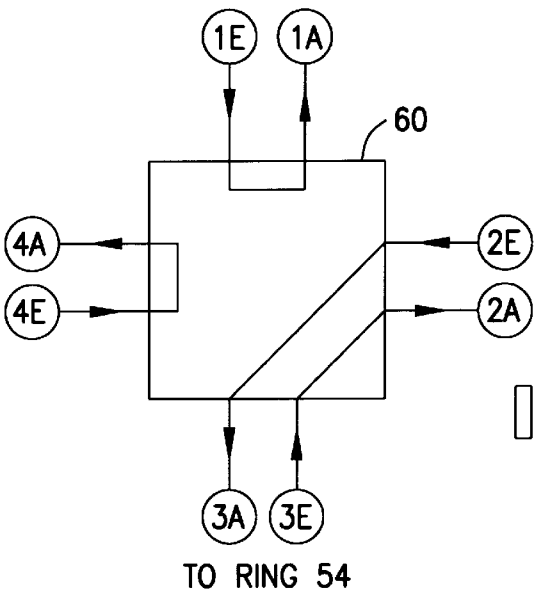

As discussed above, fulfillment of the requirements of a newspaper rotary press with regard to flexibility and redundancy lies in the design of the serial bus system with which the synchro is implemented. FIGS. 4 and 5 show the principle of flexible assignment of the drives and the interconnection of two separate synchronization bus rings 54 and 56 to form a single ring with a device 50.

Flexibility:

A printing station, e.g., printing station DS3 in FIG. 4, is synchronized with folding unit 16 during one production run. Without mechanical intervention, there must be a possibility for connecting this drive to an adjacent rotation for another production.

Each drive which is to run in angular synchronization with other drives over a synchro can be synchronized by two independent synchronization buses 44. Each drive therefore has two bus interfaces 46 and 48. In the example of printing station DS3, this drive is connected to the two synchronization bus rings 54 and 56. Thus, the drive can either run in synchronization with folding unit 16 over device 50 or it can work in synchronization bus ring 56 as part of the second rotation (in synchronization with folding unit 18). By parameterization on the drive, it is ascertained from which device 50 synchronization and selection of the angle setpoint take place. With this mechanism, the machine operator can implement the assignment of one printing station to two folding units 16 and 18 by simple parameter switching on the drive.

The restriction to two devices 50 and thus to two folding units 16 and 18 is sufficient from a practical standpoint. Synchronization with a third folding unit takes place only when there is a disturbance in a rotation, i.e., when there is a failure of a folding unit 16 or 18, and it is covered by the redundancy concept with bus switch 60.

Redundancy:

In the case of a failure of one folding unit 16 or 18, emergency operation is necessary to maintain production in the sense that it must be possible for all the printing stations of this first and second rotation to be switched to an adjacent folding unit 18 or 16 or to a stand-by folding unit. For such emergency operation, mechanical provisions must be taken (possibility of guiding the paper web) and there must also be technical control options. Implementation of such emergency operation makes the following demands on the design of the synchro: with the failure of folding unit 16 or 18, device 50 of synchronization bus ring 54 or 56 also becomes nonfunctional. If all the drives of this first or second rotation are to be switched to another folding unit 18 or 16, synchronization bus ring 54 or 56 must be assigned to a new device 50 of new folding unit 18 or 16. This is accomplished by means of bus switch 60.

Bus switch 60 is a component of synchronization bus 44 for dividing the line control of optical fiber ring 54 or 56.

FIG. 5 shows two examples of the function of switch 60. Bus switch 60 is always assigned directly to a device 50 of a folding unit 16 or 18. The design principle is explained on the basis of the following example.

As shown in FIG. 4, the rotary printing press includes three folding units, two of which, folding units 16 and 18, are shown for the first and second rotations. Folding unit 16 fails in the first production. The second production is shut down. Two bus switches 60 are switched to another line control shown in FIG. 5. Therefore, all the drives which were previously in the two separate synchronization bus rings 54 and 56 are now combined in one ring 56. Production can then be continued as emergency operation. Likewise, instead of connecting the drives in a synchronization bus ring 54 or 56, failed folding unit 16 or 18 may also be replaced by a stand-by folding unit. In this case, synchronization bus ring 54 or 56 is connected to a device of the stand-by unit by switching the switches 60.

We claim:

1. A shaftless rotary printing press, comprising:

a drive controller;

a plurality of drives coupled to the drive controller via a control and parameterization bus, each of the plurality of drives including an electric motor and a bus interface coupled to a synchronization bus, the synchronization bus including a ring bus and operating in parallel to the control and parameterization bus;

a plurality of individually driven printing stations, each of the plurality of individually driven printing stations being driven by a respective one of the plurality of drives;

at least one separately driven folding unit operating with the plurality of drives in one rotation; and a device coupled to the first synchronization bus and generating a first setpoint and a first synchronization signal.

2. The shaftless rotary printing press according to claim 9, wherein the control and parameterization bus includes an open field bus.

3. The shaftless rotary printing press according to claim 1, wherein the synchronization bus includes a high-speed bus system.

4. The shaftless rotary printing press according to claim 1, wherein only information ensuring angular synchronization of the plurality of drives in the one rotation is transmitted over the synchronization bus.

5. The shaftless rotary printing press according to claim 1, wherein a plurality of signals for control, diagnosis, and parameterization of each of the plurality of drives are transmitted over the control and parameterization bus.

6. The shaftless rotary printing press according to claim 1, wherein an angle value of a control vector, an offset angle and a synchronization signal are provided as information for each of the plurality of drives.

7. The shaftless rotary printing press according to claim 1, wherein the synchronization bus includes a transmission line, the transmission line being an optical fiber.

8. A shaftless rotary printing press, comprising:

a drive controller;

a first separately driven folding unit;

a second separately driven folding unit;

a plurality of drives coupled to the drive controller via a control and parameterization bus, each of the plurality of drives including an electric motor, a first interface coupled to a first synchronization bus, and a second bus interface coupled to a second synchronization bus, each of the first synchronization bus and the second synchronization bus including a ring bus and operating in parallel to the control and parameterization bus, each respective one of the plurality of drives operating with a selected one of i) the first separately driven folding unit in a first rotation via the first bus interface, and ii) the second separately driven folding unit in a second rotation via the second bus interface;

a plurality of individually driven printing stations, each of the plurality of individually driven printing stations being driven by a respective one of the plurality of drives;

a first device coupled to the first synchronization bus via a first bus switch generating a first setpoint and a first synchronization signal; and a second device coupled to the second synchronization bus via a second bus switch generating a second setpoint and a second synchronization signal.

9. The shaftless rotary printing press according to claim 6, wherein the control and parameterization bus includes an open field bus.

10. The shaftless rotary printing press according to claim 8, wherein at least one of the first synchronization bus and the second synchronization bus includes a high-speed bus system.

11. The shaftless rotary printing press according to claim 8, wherein only information ensuring angular synchronization of each of the plurality of drives operating in the first rotation is transmitted over the first synchronization bus and wherein only information ensuring angular synchronization of each of the plurality of drives operating the second rotation is transmitted over the second synchronization bus.

12. The shaftless rotary printing press according to claim 8, wherein a plurality of signals for control, diagnosis, and parameterization of each of the plurality of drives are transmitted over the control and parameterization bus.

13. The shaftless rotary printing press according to claim 8, wherein an angle value of a control vector, an offset angle and a synchronization signal are provided as information of each of the plurality of drives.

14. The shaftless rotary printing press according to claim 8, wherein each of the first synchronization bus and the second synchronization bus includes a transmission line, the transmission line being an optical fiber.

* * * * *